US005947574A

United States Patent [19]

Avendano

[11] Patent Number: 5,947,574

[45] Date of Patent: Sep. 7, 1999

[54] REFRIGERATOR SHELVING ASSEMBLY

[75] Inventor: Jose G. Avendano, Galesburg, Ill.

[73] Assignee: Maytag Corporation, Newton, Iowa

[21] Appl. No.: 08/869,006

[22] Filed: Jun. 4, 1997

[51] Int. Cl.[6] ..... A47B 96/04; F25D 25/02

[52] U.S. Cl. ..... 312/408; 312/404; 312/351

[58] Field of Search ..... 312/408, 410, 312/404, 351, 296, 330.1; 108/108, 27

[56] References Cited

U.S. PATENT DOCUMENTS

| | | | |
|---|---|---|---|
| 1,967,979 | 7/1934 | Stern . | |
| 2,241,053 | 5/1941 | Brightman . | |
| 2,682,754 | 7/1954 | Eck | 312/408 X |
| 3,266,858 | 8/1966 | Klotz . | |
| 3,633,983 | 1/1972 | Whitcomb | 312/351 X |
| 3,826,550 | 7/1974 | Propst et al. | 312/351 X |
| 3,912,210 | 10/1975 | Von Bohr . | |
| 4,691,644 | 9/1987 | Frydman . | |
| 4,729,613 | 3/1988 | Tromble et al. . | |
| 4,735,470 | 4/1988 | Falk . | |
| 4,934,541 | 6/1990 | Bussan et al. . | |
| 4,936,641 | 6/1990 | Bussan et al. | 312/408 |
| 4,960,308 | 10/1990 | Donaghy . | |
| 5,044,704 | 9/1991 | Bussan et al. . | |
| 5,441,338 | 8/1995 | Kane et al. . | |
| 5,641,217 | 6/1997 | Caruso et al. | 312/408 X |

FOREIGN PATENT DOCUMENTS

| | | | |
|---|---|---|---|
| 152981 | 8/1953 | Australia | 312/408 |
| 975649 | 3/1951 | France | 312/404 |
| 559700 | 3/1957 | Italy | 312/408 |

*Primary Examiner*—Peter M. Cuomo
*Assistant Examiner*—Hanh V. Tran
*Attorney, Agent, or Firm*—Everett G. Diederiks, Jr.

[57] ABSTRACT

A refrigerator shelving assembly includes a universal frame adapted to support various different shelving units thereon. The frame is defined by interconnected front, rear and side frame members, and preferably a pair of intersecting cross frame members. Each of the frame members, in at least an opposing pair of the front, rear and side frame members, is provided with a ledge portion located in a first plane and a trough portion arranged below the first plane at a position between the ledge portions and a respective cross frame member. Each of the cross frame members has an upper surface also located in the first plane. With this construction, the frame can universally support various types of shelving units, including a basic shelf constituted by a plate of glass or a premium shelf formed by encapsulating an annular portion of a plate of glass by a rim defining element that extends below a plane defined by the glass plate, upon the cross frame members and either the ledge or trough portions of the shelving assembly. Furthermore, the frame members can carry guide rails for slidably supporting one or more refrigerator bins below a selected shelving unit.

25 Claims, 3 Drawing Sheets

REFRIGERATOR SHELVING ASSEMBLY

BACKGROUND OF THE INVENTION

1. Field of the Invention

The present invention pertains to the art of refrigerators and, more particularly, to a shelving assembly including a universal frame adapted to support any one of a plurality of different shelving units.

2. Discussion of the Art

Refrigerator manufacturers make available various refrigerator models which can range from basic models to high-end models. The different models can vary in numerous respects, including size, components utilized, features and, accordingly, price. In order to reduce manufacturing costs in the art of refrigerators, it is often desirable to produce some parts which are common to all or at least a few of the refrigerator models and then to accessorize these parts with varying components to distinguish the various models. For example, it is known in the art to utilize a similarly constructed refrigerator cabinet liner in various models but to attach different types of shelves and bins therein to distinguish the various models from one another. Therefore, some basic structure will be common to various models, but the overall features can differ substantially.

Increasing the number of common components can result in substantial cost savings when realized over various product lines. However, attempting to design certain components to be universal can also require major changes to the accessories used in combination therewith such that no actual cost savings are realized. In addition, designing universal components can raise engineering problems, particularly when those components have varying forces exerted thereon during use and those forces are distributed in different ways when each of the universal components is used in combination with different accessories.

SUMMARY OF THE INVENTION

The present invention is directed to a refrigerator shelving assembly that incorporates a frame configured to support various different types of shelving units. More specifically, the invention incorporates a universal shelving frame that can be mounted in the cabinets of different refrigerator models and used to vertically support different types of shelves in varying locations upon the frame. In a preferred embodiment of the invention, the universal shelving frame also incorporates structure to enable one or more bins to be slidably supported there below.

These aspects of the invention are achieved by providing a shelving frame defined by interconnected front, rear and side frame members, as well as one or more cross frame members. Each of the frame members, in at least an opposing pair of the front, rear and side frame members, is provided with a ledge portion located in a first plane and a trough portion arranged below the first plane at a position between the ledge portion and the cross frame member. The cross frame member has an upper surface that extends in the first plane.

With this construction, a first type of shelving unit, constituted by a planar member such as a plate of glass, can be supported on the frame with the planar member resting upon the various ledge portions and the upper surface of the cross frame member. In addition, another type of shelving unit, such as a planar member which is encapsulated about an annular portion thereof by a rim defining element such that a portion of the rim extends below a plane defined by the shelving unit, can be supported at the trough portions and upon the cross frame member. Therefore, the single shelving support frame constructed in accordance with the present invention can accommodate various different types of shelving units, ranging from a basic, relatively inexpensive unit defined by a unitary planar member to a premium shelving unit defined by a planar member formed with an integral annular rim. In addition, the supporting frame in accordance with the invention is formed with guide rails which enable one or more bins to be slidably supported beneath the shelving unit.

Additional features and advantages of the invention will become more readily apparent from the following detailed description of two preferred embodiments of the invention when taken in conjunction with the drawings wherein like reference numerals refer to corresponding parts in the several views.

DETAILED DESCRIPTION OF THE PREFERRED EMBODIMENTS

Figure 1:
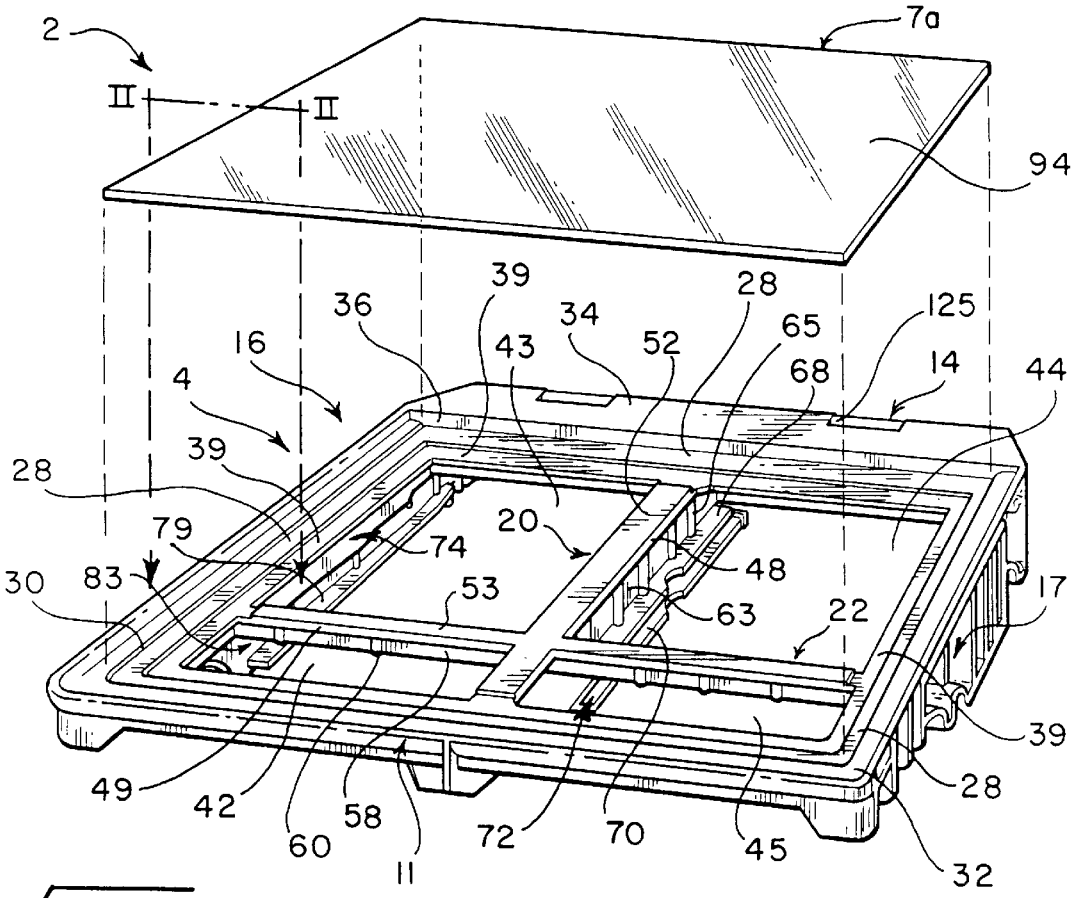
FIG. 1 is an exploded view of a refrigerator shelving assembly constructed in accordance with a first embodiment of the invention.

With initial reference to FIG. 1, the refrigerator shelving assembly constructed in accordance with the present invention is indicated at 2 and generally defined by a supporting frame 4 and a shelving unit 7*a*. In this figure, supporting frame 4 is shown reversed to better illustrate its construction and includes a rear frame member 11, a front frame member 14 and a pair of side frame members 16 and 17, all of which are interconnected together so as to form a generally rectangular-shaped frame which is adapted to be mounted within a compartment of a refrigerator by any means known in the art. In the preferred embodiment, supporting frame 4 is formed as a unitary, plastic member through an injection molding process, however, it should be understood that supporting frame 4 could equally be formed of various separate components that are interconnected together. Supporting frame 4 also includes a front-to-rear cross frame member 20 and a side-to-side cross frame member 22, the preferred constructions of which will be detailed below.

Figure 2:
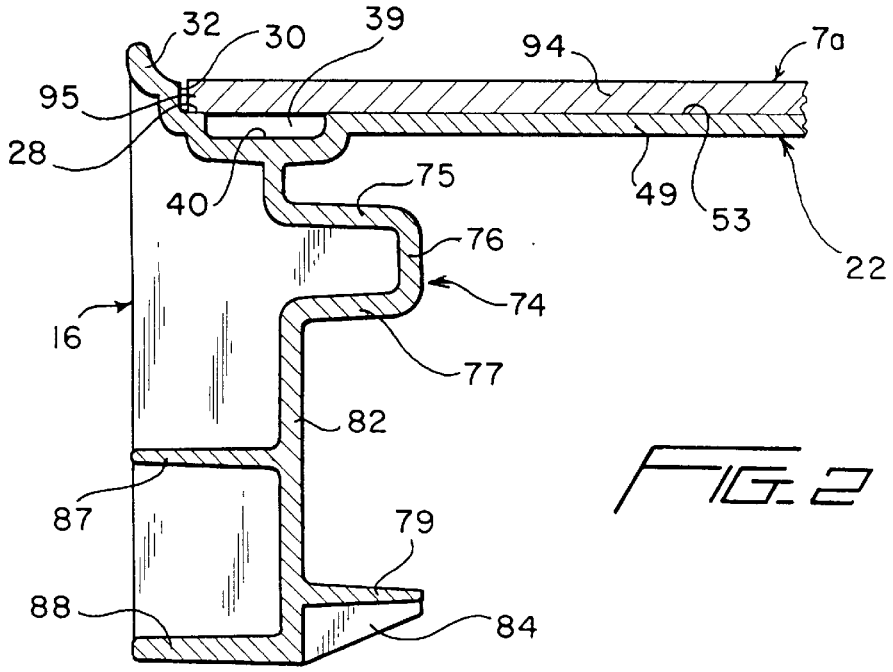
FIG. 2 represents a cross-section generally taken vertically at II—II in FIG. 1.

With reference to FIGS. 1 and 2, supporting frame 4 has an upper ledge 28 that extends about supporting frame 4 in a first plane. As will become more fully apparent below, ledge 28 defines a first shelving support located at an upper level of supporting frame 4. Ledge 28 terminates in an outer upstanding wall 30 that leads to an upwardly curved, peripheral edge portion 32 of supporting frame 4. Unlike ledge 28, peripheral edge portion 32 preferably only extends along rear frame member 11 and side frame members 16 and 17. At front frame member 14, peripheral edge portion 32 merges with a front plate section 34 of supporting frame 4.

Front plate section 34 includes an upright wall portion 36 which projects above ledge 28 such that front plate section 34 is arranged above ledge 28. Actually, front plate section 34 preferably extends above ledge 28 an amount commensurate with peripheral edge portion 32 as shown in FIG. 1. With this construction, both peripheral edge portion 32 and front plate section 34 will aid in preventing items placed upon shelving unit 7*a* from inadvertently spilling over or being knocked off shelving assembly 2.

Spaced inwardly of ledge 28, supporting frame 4 is formed with a trough portion 39 that defines a second, lower shelving support level. Trough portion 39 includes a base 40 which, as will be described more fully below, is also adapted to perform a shelf supporting function. As clearly shown in FIG. 1, trough portion 39 extends along each of the rear, front and side frame members 11, 14, 16 and 17 respectively. Except at front-to-rear and side-to-side cross frame members 20 and 22, trough portion 39 leads into open areas 42–45 within supporting frame 4. Front-to-rear and side-to-side cross frame members 20 and 22 include respective upper, generally horizontally extending sections 48 and 49, each of which has a respective upper surface 52, 53 which extends in the same plane as ledge 28 as clearly illustrated in FIG. 2 with reference to side-to-side cross frame member 22.

More specifically, again with reference to FIG. 1, cross frame member 22 is generally T-shaped in cross-section with upper section 49 having attached thereto a central, downwardly extending flange portion 58. To add structural rigidity to side-to-side cross frame member 22, central flange portion 58 is formed with various bulging sections 60. On the other hand, front-to-rear cross frame member 20 is preferably wider than side-to-side cross frame member 22 and is formed with a pair of laterally spaced side flanges, one of which is shown at 63. Extending along side flanges 63 is a plurality of spaced, vertical reinforcement ribs 65 that interconnect upper section 48 of cross member 20 to an upper guide member 68. Spaced below upper guide member 68 and also joined with a respective side flange 63 is a lower guide member 70. As shown, upper and lower guide members 68 and 70 extend from adjacent front frame member 14 toward rear frame member 11 and define an inner guide channel 72 therebetween. Although the function of guide channel 72 will become more fully realized hereinafter, at this point it should be noted that front-to-rear cross frame member 20 preferably includes a similarly constructed guide channel 72 on each lateral side thereof.

As shown with reference to side frame member 16 in FIGS. 1 and 2, each side frame member 16, 17 is also formed with an upper guide member 74. In the preferred embodiment shown, each upper guide member 74 includes a laterally inwardly extending portion 75, a downwardly extending portion 76 and a laterally outwardly extending portion 77. In addition, each side frame member 16, 17 includes a lower guide member 79 that projects inwardly from a respective inner side wall member 82. Each of the guide members 74 and 79 actually extends rearwardly from front plate section 34 to adjacent cross frame member 22. With this construction, an outer guide channel 83 is defined between the upper and lower guide members 74 and 79, adjacent each lateral end of supporting frame 4. For reinforcement purposes, lower guide member 79 is further interconnected to inner side wall member 82 through a plurality of spaced reinforcing ribs 84. Inner side wall member 82 is also provided with various, laterally outwardly extending structural ribs, two of which are shown at 87 and 88 in FIG. 2.

Figure 3:
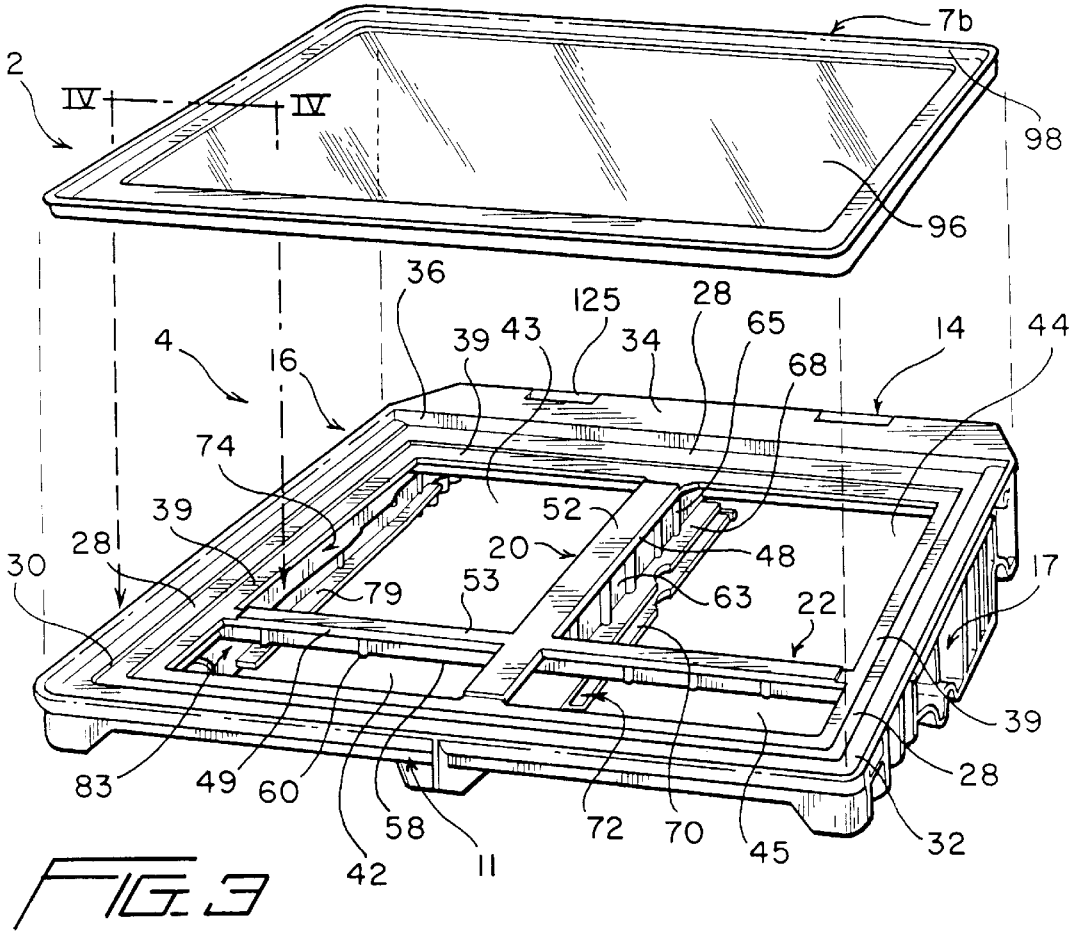
FIG. 3 is an exploded view of a refrigerator shelving assembly constructed in accordance with a second embodiment of the invention.
Figure 4:
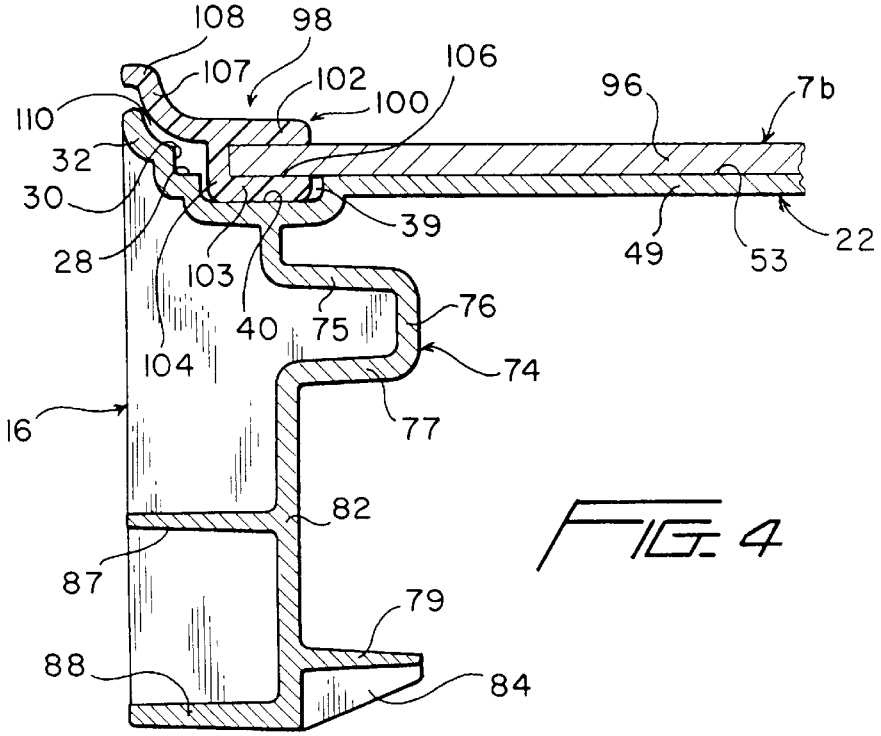
FIG. 4 represents a cross-section generally taken vertically at IV—IV in FIG. 3.

With the above-described construction, supporting frame 4 can be universally utilized in supporting various different types of shelves. For example, FIGS. 1 and 2 illustrate one preferred embodiment wherein shelving unit 7*a* is defined by a planar shelf member 94, such as a plate of glass. Planar shelf member 94 can be readily supported upon supporting frame 4 with an outer peripheral portion 95 of planar shelf member 94 resting upon ledge 28 and additional portions (not separately labeled) of planar shelf member 94 resting upon upper surfaces 52 and 53 of cross frame members 20 and 22. It can be readily seen from viewing FIG. 2 that, when supporting frame 4 is used in combination with planar shelf member 94, planar shelf member 94 extends across trough portion 39 at a position spaced vertically above base 40. However, FIGS. 3 and 4 illustrate another preferred embodiment of the invention wherein a shelving unit 7*b* of refrigerator shelving assembly 2 is constituted by a planar member 96 (also preferably made of glass) that is encapsulated by an annular rim 98. As can be seen by comparing FIGS. 2 and 4, planar member 96 is slightly smaller than the corresponding planar member 94 according to the first embodiment of the invention. In any event, rim 98 includes a body portion 100 having an upper shelf covering element 102 and a lower shelf covering element 103 which are interconnected by a leg element 104. With this construction, body portion 100 is generally U-shaped in cross-section (see FIG. 4) so as to define a cavity 106 into which planar shelf member 96 extends.

Figure 5:
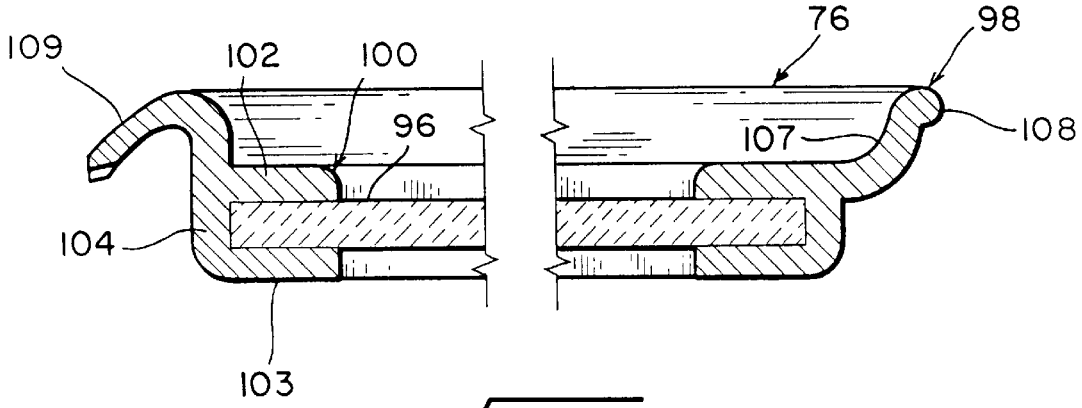
FIG. 5 is a broken cross-section side view of a shelf unit utilized in the embodiment of FIG. 3.

Rim 98 also includes an up-turned peripheral lip portion 107 that extends around the two sides and rear of planar member 96 and terminates in an outer edge 108 which can be grasped such that planar member 96 can be transported in a manner analogous to a conventional serving tray. As best shown in FIG. 5, a frontal lip portion 109 is down-turned to meet with front plate section 34 (also see FIG. 6). Shelving unit 7*b* is adapted to be supported upon frame 4 with body portion 100 of rim 98 extending into trough portion 39 (FIG. 4) such that lower covering element 103 rests upon base 40. The thickness of lower covering element 103 corresponds to that of upper sections 48 and 49 of cross frame members 20 and 22 such that planar member 96 further rests upon the upper surfaces 52 and 53 of cross frame members 20 and 22. In this position, up-turned peripheral lip portion 107 of rim 98 generally follows the contour of upwardly curved, peripheral edge section 32 with a space 110 therebetween as clearly shown in FIG. 4.

At this point, it should be realized that peripheral edge portion 32 is designed in such a way so that it serves as a wall that keeps objects from falling off of shelf unit 7*a*. At the same time, peripheral edge portion 32 has to be small enough to enable it to be completely covered by shelving unit 7*b* since shelving unit 7*b* uses outer edge 108 as the wall that keep objects and liquids from falling/dripping over its edge. When using shelving unit 7*b*, the preferred design has the intent of completely covering side frame members 16 and 17, as well as rear frame member 11, to prevent any spillage onto frame 4. Therefore, both peripheral edge portion 32 and outer edge 108 have related height and width restrictions in accordance with the preferred design of the present shelving assembly.

Therefore, based on the above description, it should be readily apparent that the supporting frame 4 incorporated in the refrigerator shelving assembly 2 of the invention can be used to support, in different ways, various types of shelving units, including a simple planar shelving unit 7*a* and an encapsulated shelving unit 7*b*. As indicated above, shelving unit 7*a* uses ledge 28 and surfaces 52 and 53 as resting surfaces, while shelving unit 7*b* uses base 40 and surface 52 and 53 as resting surfaces. Therefore, while utilizing either shelving unit 7*a* or shelving unit 7*b*, surfaces 52 and 53 defining resting surfaces and the vertical location of both shelving units 7*a* and 7*b* is the same. This arrangement advantageously enables varying of the particular shelving unit utilized while maintaining the same storage capacity of the refrigerator since the planar shelf members 94 and 96 will be spaced equal distances from an adjacent, upper shelf in the refrigerator compartment. In the preferred embodiment, refrigerator shelving assembly 2 is also used to support crisper bins (not shown), each of which is to be slidably received within a respective pair of inner and outer guide channels 72 and 83. Of course, refrigerator shelving assembly 2 need not be used in combination with bins and therefore the need for the structure defining the inner and outer guide channels could be obviated. In addition, a single bin could be supported without departing from the invention which would only obviate the need for the structure defining inner guide channels 72.

Figure 6:
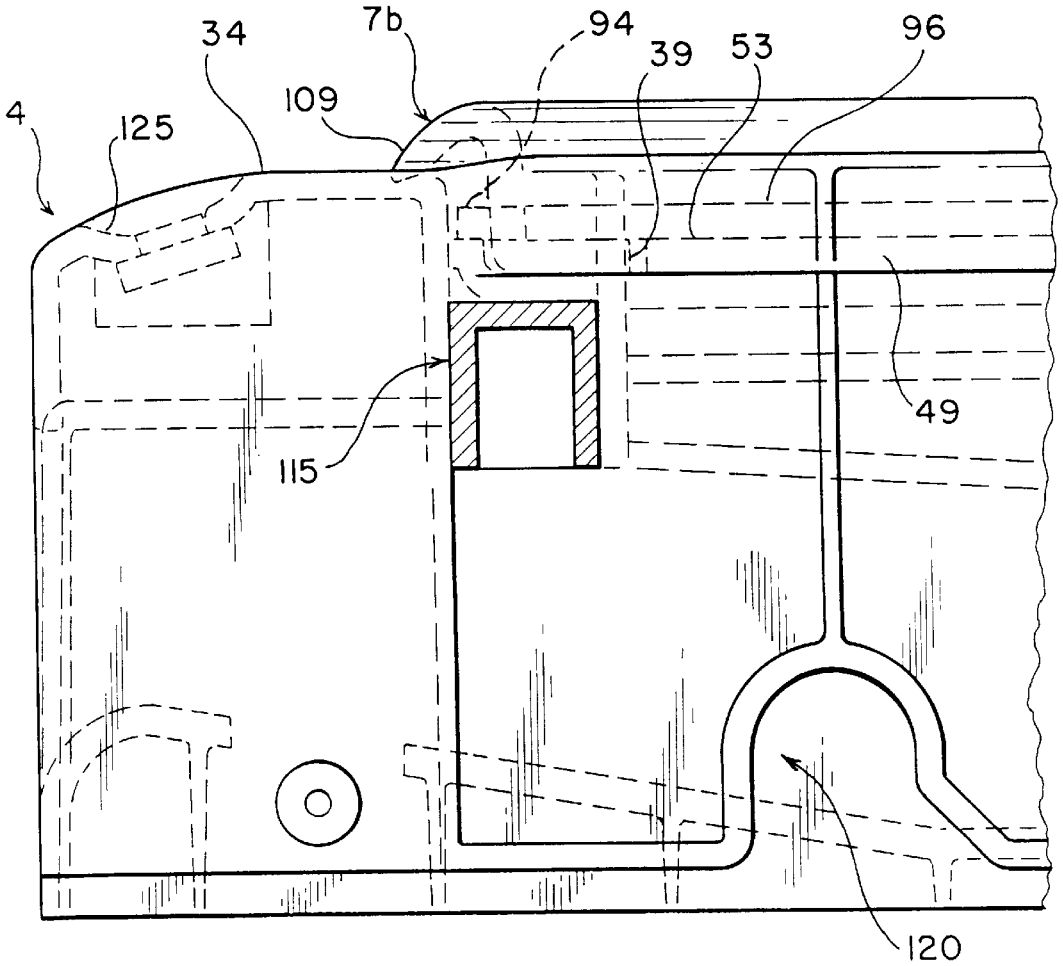
FIG. 6 is a schematic, partial side view of the shelving assembly of the invention.

As food items are often placed toward the front of a refrigerator shelf, the present invention contemplates the incorporation of a reinforcing member that extends across a front portion of supporting frame 4. This arrangement is illustrated in FIG. 6 wherein a generally inverted U-shaped reinforcing bar 115 is shown arranged rearward of front plate section 34 and generally below base 40. Since the use of such reinforcing members are quite old in the art, it is not considered part of the present invention and is therefore only discussed for the sake of completeness. In general, reinforcing bar 115 runs across the full width of supporting frame 4, from side frame member 16 to side frame member 17 and increases the structural integrity of shelving assembly 2. Reinforcing bar 115 is supported at side frame members 16 and 17, as well as by cross frame member 20. With this arrangement, when items are placed on shelving unit 7*a* or 7*b*, reinforcing bar 115 reduces the amount of deflection that the shelf will experience.

FIG. 6 also illustrates the presence of a preferred mounting support, generally indicated at 120, which is adapted to receive a respective mounting pin (not shown) that projects from the refrigerator liner. Of course, at least two such mounting supports 120 would be used in connection with each side frame member 16 and 17. Finally, this figure indicates the presence of a slotted area 125 formed in front plate section 34. Slotted area 125 is adapted to receive a slidable control member (not shown) for adjusting the flow of cooling/humidifying air into crisper bins adapted to be supported by frame 4. Actually, a pair of slotted areas 125 are generally indicated in FIGS. 1 and 3 as well.

Although described with respect to preferred embodiments of the invention, it should be realized that various changes and/or modifications can be made to the invention without departing from the spirit thereof. For example, although shelving units 7*a* and 7*b* are shown and described as extending completely across supporting frame 4, each shelving unit 7*a*, 7*b* could be formed in multiple sections wherein front-to-rear cross frame member 20 would include opposing lateral portions constructed with ledge and trough portions analogous to that on the rear, front and side frame members 11, 14, 16 and 17 respectively. In addition, ledge 28 and trough 39 need not extend completely about supporting frame 4 but could be provided simply on certain ones of the rear, front and side frame members 11, 14, 16 and 17, such as only on an opposing pair of these frame members. Furthermore, additional cross frame members could readily be provided. In general, the invention is only intended to be limited by the following claims.

I claim:

1. A refrigerator shelving assembly comprising:

a first pair of opposing frame members defined by a front frame member and a rear frame member which is spaced from said front frame member;

a second pair of opposing frame members defined by laterally spaced side frame members, each of said side frame members being interconnected with said front and rear frame members such that said first and second pairs of opposing frame members combine to form an overall supporting frame adapted to be mounted within a refrigerator cabinet;

at least one cross frame member extending between and interconnecting one of said first and second pairs of opposing frame members, said at least one cross frame member having an upper surface arranged in a first plane;

each of the frame members of at least one of said first and second pairs of opposing frame members including a ledge portion located in said first plane and a trough portion arranged below said first plane at a position between said ledge portion and said at least one cross frame member, wherein the ledge portions and the at least one cross frame member are adapted to support a first configured shelving unit which includes a first peripheral section rested upon said ledge portions, and wherein the trough portions and the at least one cross frame member are adapted to support a second configured shelving unit which is structurally different than the first configured shelving unit and includes a second peripheral section rested in said trough portions, such that either one of first and second configured shelving units can be alternatively supported by the at least one of said first and second pairs of opposing frame members; and a shelving unit extending across at least a portion of said first and second pairs of opposing frame members, said shelving unit being supported upon said at least one cross frame member and a predetermined group of said ledge and trough portions.

2. The refrigerator shelving assembly according to claim 1, wherein said shelving unit comprises a planar member that is supported by said at least one cross frame member and said ledge portions at a position spaced above said trough portions.

3. The refrigerator shelving assembly according to claim 2, wherein said planar member is constituted by a plate of glass.

4. The refrigerator shelving assembly according to claim 1, wherein said shelving unit comprises a planar member that is encapsulated at an outer peripheral portion thereof by a rim member, said rim member including body portions seated in said trough portions, said planar member being supported upon said supporting frame by said at least one cross frame member and said rim member.

5. The refrigerator shelving assembly according to claim 4, wherein said planar member is constituted by a plate of glass and said rim member is formed with a cavity which receives said plate of glass.

6. The refrigerator shelving assembly according to claim 4, wherein said rim member includes an outer, up-turned peripheral lip that is spaced above said overall supporting frame.

7. The refrigerator shelving assembly according to claim 1, wherein each of said front frame member, said rear frame member and said side frame members is formed with respective said ledge and trough portions such that each of said ledge and trough portions extend annularly about said overall supporting frame.

8. The refrigerator shelving assembly according to claim 7, wherein said shelving unit comprises a planar member that is supported by said at least one cross frame member and each of said ledge portions at a position spaced above said trough portions.

9. The refrigerator shelving assembly according to claim 7, wherein said shelving unit comprises a planar member that is encapsulated at an outer peripheral portion thereof by an annular rim member seated in each of said trough portions, said planar member being supported by said at least one cross frame member and said rim member.

10. The refrigerator shelving assembly according to claim 1, wherein said at least one cross frame member comprises a first cross frame member extending between and interconnecting said first pair of opposing frame members and a second cross frame member extending between and interconnecting said second pair of opposing frame members, said first and second cross frame members intersecting within said overall supporting frame.

11. The refrigerator shelving assembly according to claim 1, wherein each of the frame members of said second pair of opposing frame members is provided with a guide rail which is located below said shelving unit and extends from adjacent said front frame member towards said rear frame member, each of said guide rails being adapted to slidably support a refrigerator storage bin.

12. The refrigerator shelving assembly according to claim 11, wherein said at least one cross frame member comprises a first cross frame member extending between and interconnecting said first pair of opposing frame members and a second cross frame member extending between and interconnecting said second pair of opposing frame members, said first and second cross frame members intersecting within said overall supporting frame, said first cross member having opposing lateral sides each of which is provided with an additional guide rail wherein each of said additional guide rails is adapted to cooperate with a respective said guide rail on said second pair of opposing frame members in order that a pair of refrigerator storage bins can be slidably supported by said refrigerator shelving assembly.

13. A refrigerator shelving assembly comprising a front frame member, a rear frame member arranged opposite said front frame member, a pair of opposing, laterally spaced side frame members and a shelving unit, said front, rear and side frame members being interconnected to form an overall shelving unit supporting frame which is adapted to be mounted within a refrigerator cabinet, said side frame members and at least one of said front and rear frame members being unitarily formed with ledge portions located in a first plane and trough portions which are spaced inwardly of said ledge portions and arranged below said first plane, said shelving unit extending across at least a portion of said overall supporting frame and being removably supported upon a predetermined group of said ledge and trough portions.

14. The refrigerator shelving assembly according to claim 13, wherein said shelving unit comprises a planar member that is supported by said ledge portions at a position spaced above said trough portions.

15. The refrigerator shelving assembly according to claim 13, wherein said shelving unit comprises a planar member that is encapsulated at an outer peripheral portion thereof by a rim member seated in said trough portions, said planar member being supported by said rim member.

16. The refrigerator shelving assembly according to claim 15, wherein said rim member includes an outer, up-turned peripheral lip that is spaced above said overall supporting frame.

17. The refrigerator shelving assembly according to claim 13, wherein each of said side frame members is provided with a guide rail which is located below said shelving unit and extends from adjacent said front frame member towards said rear frame member, each of said guide rails being adapted to slidably support a refrigerator storage bin.

18. The refrigerator shelving assembly according to claim 13, further comprising a first cross frame member extending between and interconnecting either said front and rear frame members or said side frame members, said first cross frame member having an upper surface extending in said first plane, said shelving unit being further supported by said first cross frame member.

19. The refrigerator shelving assembly according to claim 18, wherein said first cross member extends between and interconnects said front and rear frame members, said refrigerator shelving assembly further comprising a plurality of guide rails each of which extends from adjacent said front frame member towards said rear frame member, a respective one of said plurality of guide rails being attached to each of said side frame members and on opposing sides of said first cross frame member in order that a pair of refrigerator storage bins can be slidably supported by said refrigerator shelving assembly.

20. The refrigerator shelving assembly according to claim 18, wherein said first cross frame member extends between and interconnects said front and rear frame members and said refrigerator shelving assembly further comprises a second cross frame member extending between and interconnecting said side frame members, said second cross frame member having an upper surface that extends in said first plane, said first and second cross frame members intersecting within said overall supporting frame.

21. A refrigerator shelving assembly adapted to universally support a selected one of various, differently configured shelving units within a given shelving area comprising: a frame adapted to be mounted within a refrigerator cabinet, said frame including first frame means for supporting a first configured shelving unit in the shelving area and second frame means for alternatively supporting a second configured shelving unit in the shelving area, wherein said first configured shelving unit includes a first peripheral section adapted to rest upon said first frame means, and said second configured shelving unit includes a second peripheral section adapted to rest in said second frame means.

22. The refrigerator shelving assembly according to claim 21, wherein at least portions of said first and second frame means are defined by distinct portions of the frame, with the distinct portions being located in different planes.

23. The refrigerator shelving assembly according to claim 22, wherein the first frame means comprises a ledge portion of the frame that is located in a first plane and the second frame means a trough portion of the frame which is arranged below the first plane.

24. The refrigerator shelving assembly according to claim 23, wherein the frame includes a pair of opposing frame members which are interconnected by at least one cross frame member, with the at least one cross frame member forming part of each of the first and second frame means.

25. The refrigerator shelving assembly according to claim 24, wherein each of the pair of opposing frame members is formed with both of the ledge and trough portions.

* * * * *